United States Patent [19]

Elliott

[11] 4,161,769

[45] Jul. 17, 1979

[54] ILLUMINATED HAND RAIL

[75] Inventor: Billy N. Elliott, Golden, Colo.

[73] Assignee: Zimmerman Metals, Inc., Denver, Colo.

[21] Appl. No.: 814,496

[22] Filed: Jul. 11, 1977

[51] Int. Cl.[2] ..... F21V 33/00; F21V 21/00

[52] U.S. Cl. ..... 362/146; 362/152; 362/219; 362/260

[58] Field of Search ..... 362/146, 152, 219, 260

[56] References Cited

U.S. PATENT DOCUMENTS

| | | | |
|---|---|---|---|
| 2,310,593 | 2/1943 | Orlicki | 362/146 |
| 2,721,255 | 10/1955 | Lanmon | 362/146 |
| 2,766,372 | 10/1956 | Albris | 362/146 |
| 3,057,991 | 10/1962 | Grenadier | 362/146 |
| 3,131,871 | 5/1964 | Foulds | 362/146 |
| 3,569,689 | 3/1971 | Nestrock | 362/146 |
| 3,740,541 | 6/1973 | Conradt | 362/146 |
| 3,788,206 | 1/1974 | Mulvey | 362/260 |

FOREIGN PATENT DOCUMENTS

| | | | |
|---|---|---|---|
| 881445 | 11/1961 | United Kingdom | 362/146 |

*Primary Examiner*—Edward A. Miller

*Attorney, Agent, or Firm*—Sheridan, Ross, Fields & McIntosh

[57] ABSTRACT

Combined hand rail and lighting fixture for a walkway, such as a stair flight, characterized by a tubular member with spaced openings in a lower portion of its wall in which are disposed lighting fixtures, each comprising an extruded housing, a reflector for supporting an illuminating bulb, and an extruded arcuate window closing an opening, the housing and reflector forming a space for receiving the requisite electrical conductors. Its construction is such that it inherently prevents entry of water and hence may be employed outdoors as well as indoors. After installation and wiring, the housing is preferably secured to the hand rail and replacement of a bulb may be effected by removal of a pair of securing clips and the window, only, without disturbing the housing or permanent wiring connections.

9 Claims, 5 Drawing Figures

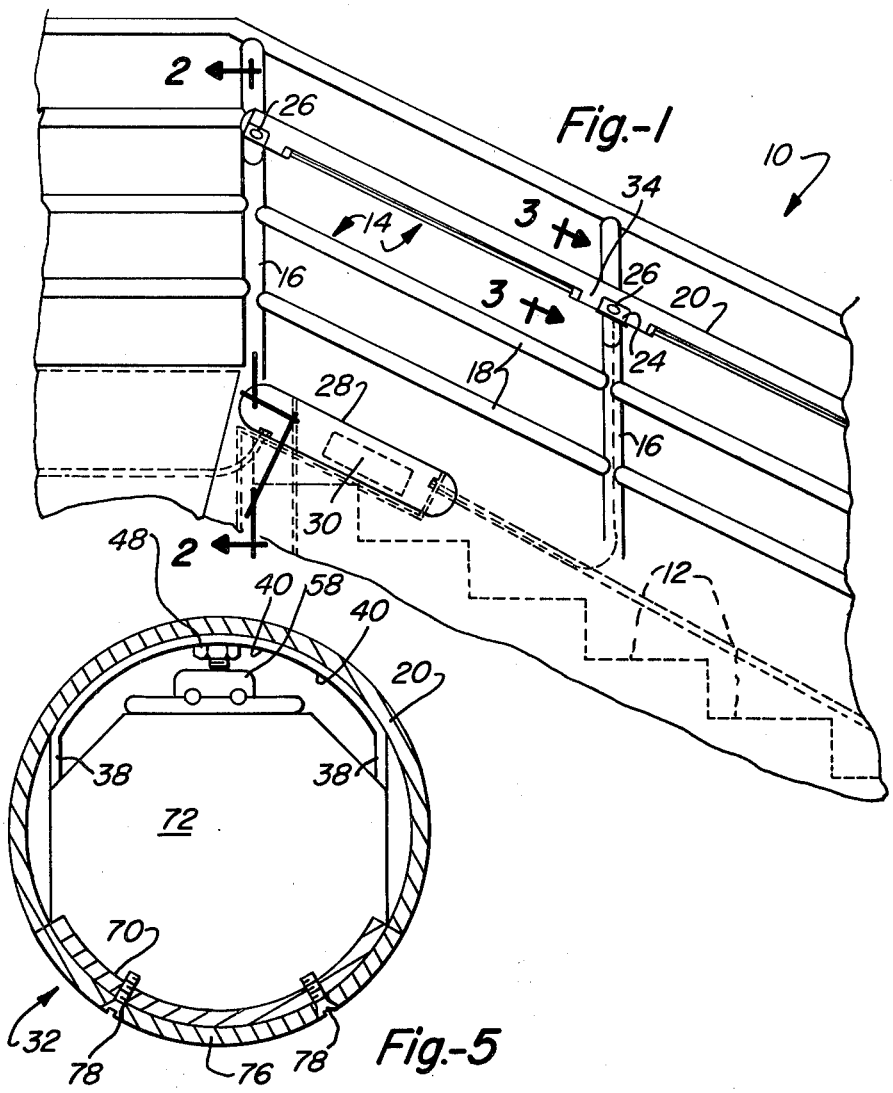
Fig.-1
Fig.-5
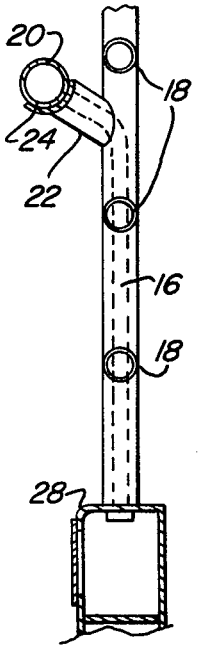
Fig.-2
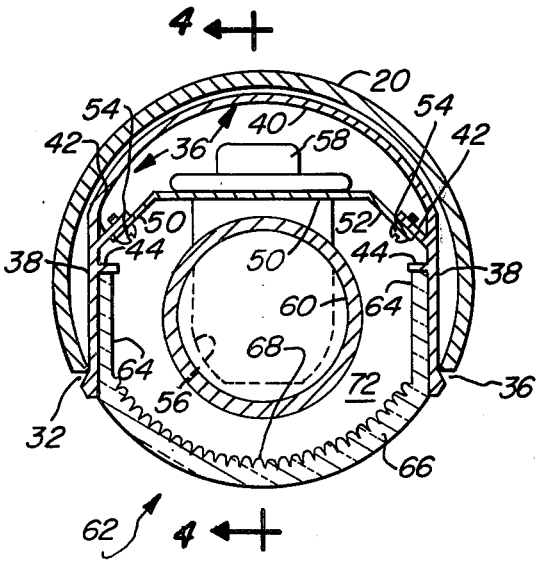
Fig.-3
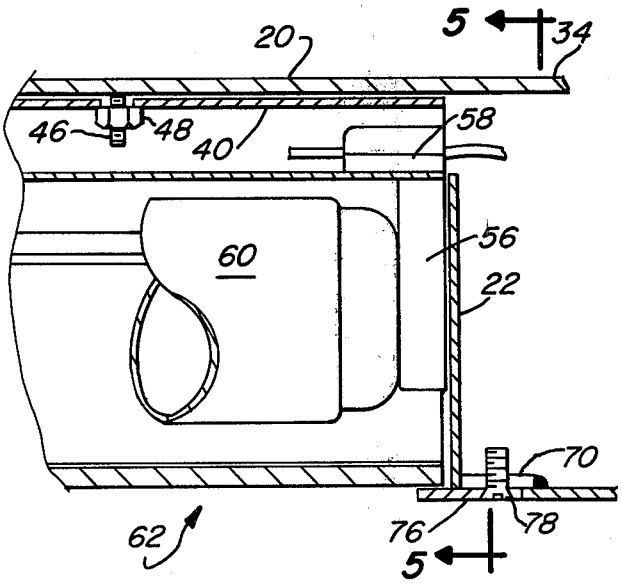
Fig.-4

ILLUMINATED HAND RAIL

BACKGROUND OF THE INVENTION

The lighting of walkways, such as stair flights, by lights concealed within a hollow hand rail or bannister disposed adjacent a walkway has been proposed, as exemplified by the patents to Albris, U.S. Pat. No. 2,766,372, and Conradt, U.S. Pat. No. 3,740,541. In these patents, specialized rail sections were required together with complicated fixtures and fittings for their assembly and the housing of the illuminating elements contained therein. The patent to Orlicki, U.S. Pat. No. 2,310,593, obviates use of specialized rail sections by utilizing conventional circular tubing, suitably modified to provide apertures therein through which light is projected downwardly onto the walkway. The Orlicki patent, accordingly, probably discloses an important concept more closely related to the present invention than the previous patents referred to except that the present invention also utilizes any configuration of tubing and modified in an entirely different manner than in the patent to Orlicki.

SUMMARY OF THE INVENTION

In the present invention, the handrail is in the nature of an attachment to a side barrier or guard adjacent a walkway, comprising spaced upright posts and a top connecting rail with welded joints. The illuminating handrail is attached to the posts parallel to the top rail and spaced from the posts. The posts are utilized for the electrical supply conduits but, as will subsequently be apparent, the illuminated handrail may also be affixed to any other type of walkway side barrier, such as a wall formed of concrete or other material. Thus, the illuminated handrail of the present invention can be a part of the guardrail or independent and separate of the guardrail, as illustrated herein. Also, it can be floor or wall mounted, as desired.

An important feature comprises the utilization of tubing, such as aluminum or stainless steel which is provided with spaced elongated cut-outs in its lower wall into which the lighting fixtures may be bodily inserted or removed. Each fixture comprises an extruded metal housing, a sheet metal reflector, and an extruded window. The housing and reflector form one space for receiving electrical wiring in a manner consonant with code requirements and another space for receiving the bulb. The window forms a continuation of the tubing wall surface which has been cut away.

A principal object of the invention, accordingly, consonant with the foregoing, is the provision of a walkway illuminating handrail formed of tubing having various cross-section configurations with spaced cut-outs in its lower wall portion for receiving fluorescent or other type light fixtures.

Another object is to construct a unitary, fixture with a normally inaccessible chamber or conduit for the permanent wiring and another readily accessible chamber for containing a bulb insertable into conventional end sockets after removal of a closure window.

Another object, consonant with the foregoing, is to provide a construction which meets the approval of code requirements and the like.

Another object is to provide an extruded housing, and extruded window, the latter being readily removable for replacement of the bulb.

Another object is to provide a window which forms a closure for the major lower portion of a handrial, forming a smooth continuation of the surface of the remaining portion thereof, which provides a maximum illumination area through that portion of the rail where most needed.

A further object is to provide an illuminated rail which is simple in construction, and which enables economical assembly.

Still further objects, advantages, and salient features will become more apparent from the detailed description to follow, the appended claims, and the accompanying drawing to now be briefly described.

BRIEF DESCRIPTION OF THE DRAWING

FIG. 1 is a side elevation of an exemplary stairway and adjacent side guard to which the illuminating hand rail or bannister of the invention is affixed;

FIG. 2 is an enlarged section taken substantially on line 2—2, FIG. 1;

FIG. 3 is an enlarged full scale section taken on line 3—3, FIG. 1;

FIG. 4 is a section taken on line 4—4, FIG. 3; and

FIG. 5 is a section taken on line 5—5, FIG. 4.

DETAILED DESCRIPTION OF PREFERRED EMBODIMENT

Referring now to the drawing in detail, and first to FIGS. 1 and 2, walkway 10 is of any conventional construction, illustrated as inclined and provided with steps 12 and a guard 14 adjacent one side thereof. The guard being formed of tubular posts 16, tubular longitudinal rails 18, and a handrail 20 affixed to the posts by support tubes 22 which carry saddles 24 to which the handrail is secured by screws 26. Electrical connection junction boxes 28, one of which is illustrated, are provided at spaced intervals along the walkway which preferably contain ballast 30 for one or more fluorescent light bulbs to be subsequently described.

Referring now to FIGS. 3–5, handrail 20, wherein the subject of the invention resides, is formed of tubing, such as stainless steel, provided with spaced cut-outs 32 in the lower portion of its wall, each cut-out providing an opening, rectangular in cross section into which a lighting fixture or assembly may be inserted. Between adjacent ends of openings, the handrail portions 34, as best illustrated in FIG. 1, are of the same general configuration as the other portions of the handrail, without cut-outs, for securing same to the spaced saddles 24.

Each lighting fixture comprises a U-shaped extrusion 36 having parallel flat side walls 38, an arcuate bight 40 joining the side walls, wings 42 projecting angularly inwardly from the side walls, and flanges 44 projecting inwardly normal to the side walls. Spaced threaded studs 46 are spot welded to handrail 20 and serve to secure the extrusion thereto by nuts 48 or the like. As will be apparent, the cross section of the extrusion across the legs is rectangular and of a length and width to fit the cut-out in the handrail lower wall portion.

Wings 42, which extend along the length of the extrusion, provide supports for a reflector plate 50 provided with bent wings 52 which are secured to wings 42 by suitable fasteners, such as rivets or screws 54. The reflector plate also serves as a support for fluorescent bulb sockets 56 at each end thereof and junction connectors 58. As will be understood, the sockets and connectors are conventional as employed with two prong fluorescent bulbs 60, hence details have been omitted in the interests of clarity.

Window 62, formed preferably as an extrusion of plastic material, either transluscent or transparent, is of a shape similar to the support extrusion previously described, comprising parallel flat walls 64 and an arcuate bight portion 66 extending therebetween. Parallel ridges 68 or other pattern configurations may be provided to facilitate light diffusion.

At the ends of each cut-out an arcuate plate 70 is welded to the inside surface of the handrail and projects slightly over the end of the cut-out, as best shown in FIG. 4. An end plate 72, best shown in FIGS. 4 and 5, forms a closure for the bulb compartment at each end thereof which may be welded to arcuate plate 70. An arcuate plate 76, secured to plate 70 by screws 78, retains the window in the position illustrated.

In addition, the reference in this application to a circular configuration for the cross-section of the handrail is provided for illustrative purposes only. It is to be understood that the handrail can have any cross sectional shape desired, such as square, rectangular, circular, polygonal or the like. The U-shaped extruded housing can be modified as necessary to fit the desired configuration. Accordingly, the window configuration can also be modified to follow the shape of the handrail and provide a smooth surface transition from the tube.

The term "cut-out", as previously referred to, is intended to mean absence of a wall portion as well as a portion actually removed from a tube. Thus, conventional circular tubing may be employed wherein the cut-outs are formed by milling, sawing, or otherwise removing a portion of the wall of circular tubing for receiving the fixtures. Alternatively, however, such machining operations may be obviated by providing extruded, rolled, or otherwise formed rail section having a cross section which is a portion of a full circle as illustrated in FIGS. 5 and 6. Short tubular sections, such as handrail sections 34 (FIG. 1) may then be butt welded to ends of adjacent sections formed as described thus providing the cut-outs without machining operations.

Throughout this specification, it is to be understood that reference is made to a fluorescent light or bulb for illustrative purposes only. Any illuminating device which can fit within the handrail device can be substituted, as desired, and still be within the scope of this invention.

What is claimed is:

1. In an illuminating hand rail arranged to be mounted adjacent a walkway for projecting light downwardly thereon, comprising:

(a) an opaque tube forming said hand rail having an elongated opening of uniform width in the lower portion of the wall thereof, the maximum cross section of said opening defining a reference rectangle of a width and length through which a unitary lighting fixture containing an elongated illuminating bulb may be inserted, said fixture comprising:

(b) an elongated U-shaped housing of uniform cross section having an arcuate bight portion adapted to abut the inner wall of the tube and longitudinal parallel spaced walls of a width substantially that of the width of the rectangle, the outer edges of said parallel spaced walls being arranged to abut the longitudinal edges of the rectangular opening in said tube whereby the interior of said tube is substantially sealed;

(c) an elongated continuous reflector plate secured to the housing along the length thereof forming a first open ended chamber therebetween at one side thereof for receiving electrical wires, and a second chamber at the other side thereof for receiving an illuminating bulb, said second chamber being disposed nearest the outer edges of said parallel spaced walls of said housing, (d) an illuminating bulb socket secured to the reflector plate and disposed in said second chamber for supporting the bulb, (e) a window closing said second chamber along the length thereof, said window being removable from the housing to provide access to the second chamber for replacing the bulb, said window including longitudinal parallel walls adapted to be inserted and closely fit between the parallel walls of the housing to substantially seal the interior of the housing and having an arcuate portion between said parallel walls said arcuate portion forming a continuation of the tube outer surface across the rectangular opening when said housing and window are inserted into said tube, and (f) removable clip means provided at each end of the window and attached to said tube to permit easy removal of the window from the housing for replacement of said bulb.

2. Apparatus in accordance with claim 1 wherein the window is an extrusion.

3. Apparatus in accordance with claim 1 including means for securing the housing to the tube after assembly thereinto and permitting access to the second chamber for replacement of the bulb by removal of the window.

4. Apparatus in accordance with claim 1 including means for closing opposite ends of the second chamber to preclude access to wiring therebeyond.

5. Apparatus in accordance with claim 1 wherein the housing is an extrusion.

6. Apparatus in accordance with claim 5 wherein the housing includes a pair of inwardly directed wings for securing the reflector thereto.

7. Apparatus in accordance with claim 1 wherein the housing includes a pair of longitudinal flanges providing abutments for edges of the window.

8. Apparatus in accordance with claim 1 including a longitudinally spaced like elongated opening in the handrail and a like fixture therein, providing a handrail portion therebetween without an opening in the lower portion thereof, a support secured to said handrail portion and to a walkway barrier disposed adjacent the walkway, and electrical conduits extending through said support, thence through at least a portion of said handrail portion, and thence into said first open-ended chamber for energizing the illuminating bulb contained in the second chamber.

9. Apparatus in accordance with claim 8 wherein said barrier includes a post to which said support is affixed, said electrical conduits also extending through at least a portion of the post.

* * * * *